US007258812B2

(12) United States Patent
Shimada et al.

(10) Patent No.: US 7,258,812 B2
(45) Date of Patent: Aug. 21, 2007

(54) COMPOUND MAGNETIC MATERIAL AND FABRICATION METHOD THEREOF

(75) Inventors: Yoshiyuki Shimada, Itami-shi (JP); Hitoshi Oyama, Itami-shi (JP); Takao Nishioka, Itami-shi (JP)

(73) Assignees: Sumitomo Electric Sintered Alloy, Ltd., Nariwa-cho (JP); DENSO CORPORATION, Kariya-shi (JP)

( * ) Notice: Subject to any disclaimer, the term of this patent is extended or adjusted under 35 U.S.C. 154(b) by 249 days.

(21) Appl. No.: 10/490,096

(22) PCT Filed: Oct. 28, 2002

(86) PCT No.: PCT/JP02/11180

§ 371 (c)(1),
(2), (4) Date: Mar. 17, 2004

(87) PCT Pub. No.: WO03/038843

PCT Pub. Date: May 8, 2003

(65) Prior Publication Data

US 2004/0258552 A1 Dec. 23, 2004

(30) Foreign Application Priority Data

Oct. 29, 2001 (JP) ..... 2001-330744

(51) Int. Cl.
*H01F 1/26* (2006.01)
*H01F 1/33* (2006.01)

(52) U.S. Cl. ..... 252/62.55; 148/104; 419/30; 419/38; 419/62

(58) Field of Classification Search ..... 252/62.55; 148/104; 419/30, 38, 65
See application file for complete search history.

(56) References Cited

U.S. PATENT DOCUMENTS

| | | | | |
|---|---|---|---|---|
| 5,268,140 | A * | 12/1993 | Rutz et al. | 75/246 |
| 5,591,373 | A * | 1/1997 | Ward et al. | 252/62.54 |
| 5,629,092 | A | 5/1997 | Gay et al. | |
| 5,754,936 | A * | 5/1998 | Jansson | 419/10 |
| 5,798,177 | A * | 8/1998 | Jansson | 428/403 |
| 5,980,603 | A * | 11/1999 | Thomas et al. | 75/252 |

FOREIGN PATENT DOCUMENTS

| | | |
|---|---|---|
| JP | 08 236329 | 9/1996 |
| JP | 10 503807 | 4/1998 |
| JP | 2001 155914 | 6/2001 |
| JP | 2001 210511 | 6/2001 |

* cited by examiner

*Primary Examiner*—C. Melissa Koslow
(74) *Attorney, Agent, or Firm*—W. F. Fasse; W. G. Fasse

(57) ABSTRACT

A compound magnetic material having high heat resistance is provided. A fabrication method of a compound magnetic material includes the step of preparing mixed powder including an organic resin and compound magnetic particles. The long-period heat resistance temperature of the organic resin is at least 200° C. The containing ratio of the organic resin to the compound magnetic particles exceeds 0 mass % and not more than 0.2 mass %. The compound magnetic particle includes a metal magnetic particles, and a coat layer containing metal oxide, directly bound to the surface of the metal magnetic particle. The fabrication method of a compound magnetic material includes the steps of forming a compact by introducing mixed powder into a die having a lubricant applied to its surface and conducting warm-compacting, and applying heat treatment to the compact.

6 Claims, 1 Drawing Sheet

COMPOUND MAGNETIC MATERIAL AND FABRICATION METHOD THEREOF

TECHNICAL FIELD

The present invention relates to a compound magnetic material and a fabrication method thereof. Particularly, the present invention relates to a compound magnetic material including compound magnetic particles having metal magnetic particles and a coat layer containing metal oxide, and a fabrication method thereof.

BACKGROUND ART

Reflecting the recent enhancement of global environmental control, various automobile manufacturers are affirmatively conducting development of reducing pollution by exhaust gas as well as reducing fuel consumption. Transition in the conventional engine from the mechanical control mechanism to the electronic control mechanism is now in progress, creating a demand for magnetic materials improved in performance and reduced in size as the base of the central component of the control mechanism. Particularly, research on materials having high magnetic property in the middle and high frequency range to allow control at a more precise level and through smaller power is in progress.

In order to have high magnetic properties in the middle and high frequency range, a material must have a high saturated magnetic flux density, high magnetic permeability, and a high electrical resistivity. Metal magnetic materials that have a high saturated magnetic flux density and permeability generally have a low electrical resistivity ($10^{-6}$ to $10^{-4}$ Ω cm). Therefore, the overcurrent loss in the middle and high frequency range is great. Thus, the magnetic property is deteriorated, offering difficulty in the usage as a single element.

Metal oxide magnetic materials are known to have an electrical resistivity (1-$10^{8}$ Ω cm) higher than that of metal magnetic materials, exhibiting smaller over current loss in the middle and high frequency range. Deterioration in the magnetic property is small. However, application is restricted since the saturated magnetic flux density is ⅓ to ½ the saturated magnetic flux density of the metal magnetic material.

In view of the foregoing, there are proposed compound magnetic materials that have a high saturated magnetic flux density, high magnetic permeability and high electrical resistivity by compounding a metal magnetic material with a metal oxide magnetic material to compensate for respective disadvantages.

For example, Japanese Patent National Publication No. 10-503807 discloses a method of forming a compound magnetic material by binding a plurality of compound magnetic particles having a coat of phosphoric acid iron applied to the surface of iron powder with an organic resin such as polyphenylene ether or polyetherimide and amide type oligomer.

In the case where compound magnetic material is employed for the engine control mechanism in an automobile, not only the aforementioned magnetic properties, but also heat resistance is required in view of the high temperature of the engine. However, the compound magnetic material in the above-described publication has the organic resin softened under high temperature since the compound magnetic particles are bound with an organic resin of low heat resistance such as polyphelyne ether or polyetherimide and amide type oligomer. As a result, the bind strength between adjacent compound magnetic particles becomes smaller to result in reduction of the strength of the compound magnetic material.

In view of the above-described problems, an object of the present invention is to provide a compound magnetic material of high heat resistance.

DISCLOSURE OF THE INVENTION

The inventors of the present invention dedicated their research efforts to the technique to improve heat resistance of the compound magnetic material, and found out that the resistance of a compound magnetic material can be improved by setting the long-period heat resistance temperature of the organic resin binding the compound magnetic particles to at least 200° C. and setting the rate of the organic resin to more than 0 mass % and not exceeding 0.2 mass %. In the present description, "long-period heat resistance temperature" is the heat resistance temperature defined by the UL (Underwriters Laboratories) specification 746B, used as a measure of the heat resistance limit where the dynamics property is deteriorated when a heat treatment is applied for a long period of time under zero gravity. Specifically, it indicates the temperature where a property such as tensile strength and impact strength in ambient temperature is reduced to ½ when a heat treatment is applied in the air for 100,000 hours. For the estimation of the long-period heat resistance temperature, the Arrhenius plot of an accelerated test at high temperature was employed. The inventors also found that the so-called die wall lubrication of applying in advance a lubrication material on the surface of a die used to form a compact is effective in the fabrication method of such a compound magnetic material.

A fabrication method of a compound magnetic material of the present invention based on the above findings includes the step of preparing mixed powder including an organic resin and compound magnetic particles. The long-period heat resistance temperature of the organic resin is at least 200° C. The ratio of the organic resin to the composite magnetic particles is more than 0% and not more than 0.2 mass %. The compound magnetic particle includes a metal magnetic particle, and a coat layer containing metal oxide, directly bound to the surface of the metal magnetic particle. The fabrication method of the compound magnetic material includes the step of forming a compact by introducing mixed powder into a die having a lubricant applied to its surface and conduct warm-compacting, and subjecting the compact to a heat treatment.

Introducing powder or mixed powder into a die having a lubricant applied to its surface for compacting is called "die wall lubrication compacting" hereinafter. By employing die wall lubrication compacting, it is no longer necessary to mix a lubricant into the mixed powder to prevent seizure to the mold. Thus, compressibility of the mixed powder is improved to allow high compacting density.

The temperature of the die is preferably at least 70° C. and not more than 150° C. If this temperature is below 70° C., adherence of the lubricant applied at the surface of the die to the die is low. There is a possibility of the lubricant dropping from the die surface together with the mixed powder during the powder feeding stage. If the temperature exceeds 150° C., the lubricant will be fused to reduce in the lubrication effect. There is a possibility of seizure to the die during compacting.

The term "warm-compacting" used here implies the method of compacting to reduce the yield stress and improve compressibility of the powder or mixed powder by heating the powder or mixed powder.

Usage in combination with the aforementioned die wall lubrication compacting allows higher compacting density. The heating temperature of the powder or mixed powder is preferably at least 70° C. and not more than 150° C. If this temperature is below 70° C., reduction in the yield stress of the powder or mixed powder and improvement of compressibility are small. If the temperature exceeds 150° C., the powder or mixed powder will be oxidized, imposing the problem that the quality of the product characteristics cannot be maintained.

According to a fabrication method of a compound magnetic material of the present invention including the above-described steps, a plurality of compound magnetic particles are bound to each other by an organic resin having a long-period heat resistance temperature of at least 200° C. Therefore, the organic resin will not soften even under high temperature. As a result, the heat resistance of the compound magnetic material can be improved since the bind strength between adjacent compound magnetic particles is maintained. If the ratio of the organic resin exceeds 0.2 mass %, the strength applying effect caused by necking between compound magnetic particles is reduced. This is not desirable since the transverse rupture strength at high temperature is degraded. Also, the usage of die wall lubrication is advantageous in that little, if any, lubricant has to be blended into the mixed powder. As compared to the conventional method of blending a lubricant into mixed powder, high density is allowed. The bind strength by the organic resin as well as strength applying effect caused by necking between compound magnetic particles can be improved. Thus, a compound magnetic material superior in transverse rupture strength under high temperature and having a high magnetic flux density can be provided.

Preferably, the step of preparing mixed powder includes the step of preparing mixed powder having a ratio of the organic resin to the compound magnetic particles set to at least 0.01 mass % and not more than 0.15 mass %. Since the containing amount of the organic resin is further defined, a compound magnetic material of a high electrical resistivity, transverse rupture strength, and magnetic flux density can be provided. If the ratio of the organic resin is less than 0.01 mass %, direct contact is established between compound magnetic particles, resulting in a lower electrical resistivity. If the ratio of the organic resin exceeds 0.15 mass %, the transverse rupture strength and magnetic flux density will be degraded.

Preferably, the step of forming a compact includes the step of warm-compacting the mixed powder at the temperature of at least 70° C. and not more than 150° C. If this temperature in the warm-compacting step is below 70° C., the density of the compact will be degraded, resulting in a lower magnetic flux density. If the temperature in the warm-compacting step exceeds 150° C., there is a possibility of oxidation of the metal magnetic particles.

Also preferably, the step of preparing mixed powder includes the step of preparing mixed powder including an organic resin, a compound magnetic particle, and a lubricant.

Also preferably, the step of preparing mixed powder includes the step of preparing mixed powder including an organic resin and a compound magnetic particle, wherein the remainder of the mixed powder is inevitable impurities.

The organic resin includes at least one type selected from the group consisting of thermal plastic resin including a ketone group, a thermoplastic polyether nitrile resin, thermoplastic polyalnideimide resin, thermosetting polyamide-imide resin, thermoplastic polyimide resin, thermosetting polyimide resin, a polyarylate resin, and resin including fluorine.

As thermoplastic resin including a ketone group, polyether ether ketone (PEEK, long-period heat resistance temperature 260° C.), polyether ketone ketone (PEKK, long-period heat resistance temperature 240° C.), polyether ketone (PEK, long-period heat resistance temperature 220° C.), and poly ketone sulfide (PKS, long-period heat resistance temperature 210-240° C.) can be enumerated.

As thermoplastic polyamideimide, TORLON (trade name) available from AMOCO Corporation (long-period heat resistance temperature 230° C.-250° C.) or TI5000 (trade name) available from Toray (long-period heat resistance temperature at least 250° C.) can be enumerated.

As polyarylate, Econol (trade name) (long-period heat resistance temperature 240° C.-260° C.) can be cited.

As thermosetting polyamideimide, TI1000 (trade name) available from Toray (long-period heat resistance temperature 230° C.) can be cited.

As resin including fluorine, polytetrafluoroethylene (PTFE, long-period heat resistance temperature 260° C.), tetrafluoroethylene-perfluoro alkyl vinyl ether copolymer (PFA, long-period heat resistance temperature 260° C.), and tetrafluoroethylene-hexa fluoro propylene copolymer (FEP, long-period heat resistance temperature 200° C.) can be enumerated.

Preferably, the thickness of the coat layer is at least 0.005 μm and not more than 20 μm. If this thickness is smaller than 0.005 μm, it will be difficult to obtain insulation through the coat layer. If the thickness of the coat layer exceeds 20 μm, the volume ratio of the metal oxide or metal oxide magnetic substance to the unit volume is increased. It will be difficult to achieve a predetermined saturated magnetic flux density. It is particularly preferable to set the thickness of the coat layer to at least 0.01 μm and not more than 5 μm.

Preferably, a magnetic substance can be employed for the metal oxide. The magnetic substance includes at least one type selected from the group consisting of magnetite ($Fe_3O_4$), manganese (Mn)-zinc (Zn) ferrite, nickel (Ni)-zinc (Zn) ferrite, cobalt (Co) ferrite, manganese (Mn) ferrite, nickel (Ni) ferrite, copper (Cu) ferrite, magnesium (Mg) ferrite, lithium (Li) ferrite, manganese (Mn)-magnesium (Mg) ferrite, copper (Cu)zinc (Zn) ferrite and magnesium (Mg)-zinc (Zn) ferrite.

Preferably, the metal oxide includes metal oxide magnetic particles. The metal oxide magnetic particle has an average grain size of at least 0.005 μm and not more than 5 μm. If this average grain size of metal oxide magnetic particle is smaller than 0.005 μm, production of a metal oxide magnetic particle will become difficult. If the average grain size of the metal oxide magnetic particle exceeds 5 μm, it will be difficult to render the film thickness of the coat film uniform. It is particularly preferable to set the average grain size of the metal oxide magnetic particle to at least 0.5 μm and not more than 2 μm. In the present description, "average grain size" implies the grain size of a particle having the sum of the mass of particles from the smaller grain size arriving at 50% the total mass, in the histogram of the grain size measured by the sieving method, i.e. 50% grain size of D50.

The metal oxide magnetic particle is not particularly limited, as long as it has soft magnetism and an electrical resistivity of at least $10^{-3}$ Ω cm. The aforementioned various types of soft magnetic ferrite or iron nitride can be employed. Manganese-zinc ferrite or nickel-zinc ferrite having a high saturated magnetic flux density is particularly preferable. One or more types of these ferrites may be employed.

Preferably, the metal oxide is formed of an oxide including phosphorus (P) and iron (Fe). The usage of such metal oxide is advantageous in that a thinner coat layer covering the surface of the metal magnetic particle can be provided. Accordingly, the density of the compound magnetic material can be increased to allow improvement of the magnetic property.

Preferably, the average grain size of the metal magnetic particle is at least 5 μm and not more than 200 μm. If this average grain size of the metal magnetic particle is smaller than 5 μm, the magnetic property is easily deteriorated due to metal oxidation. If the average grain size of the metal magnetic particle exceeds 200 μm, the compressibility in the compacting step will be degraded to result in reduction in the density of the compact. Accordingly, it will become more difficult to handle the compact.

Preferably, the metal magnetic particle includes at least one type selected from the group consisting of iron (Fe), iron (Fe)-silicon (Si) based alloy, iron (Fe)-nitrogen (N) based alloy, iron (Fe)-nickel (Ni) based alloy, iron (Fe)-carbon (C) based alloy, iron (Fe)-boron (B) based alloy, iron (Fe)-cobalt (Co) based alloy, iron (Fe)-phosphorus (B) based alloy, iron (Fe)-nickel (Ni)-cobalt (Co) based alloy, and iron (Fe)-aluminum (Al)-silicon (Si) based alloy. One or more types thereof can be employed. The material of the metal magnetic particle is not particularly limited and may be a metal single unit or an alloy as long as it is a soft magnetic metal.

Preferably, the magnetic flux density B is at least 15 kG when a magnetic field of at least 12000 A/m is applied, the electrical resistivity p is at least $10^{-3}$ Ω cm and not more than $10^{2}$ Ω cm. and the transverse rupture strength is at least 100 MPa at the temperature of 200° C.

It is desirable that the ratio of the metal oxide to the metal magnetic particles is at least 0.2% and not more than 30% in mass ratio. Specifically, it is desirable that (mass ratio of metal oxide)/(mass ratio of metal magnetic particle) is at least 0.2% and not more than 30%. If this ratio is below 0.2%, the electrical resistivity will be reduced to induce reduction of the alternating-current magnetic property. If the ratio exceeds 30%, the ratio of the metal oxide or metal oxide magnetic material is increased to induce reduction in the saturated magnetic flux density. More preferably, the ratio of the metal oxide or metal oxide magnetic substance to the metal magnetic particles is at least 0.4% and not more than 10% in mass ratio.

The compound magnetic material of the present invention having both a high magnetic property and high heat resistance can be employed in electronic components such as choke coils, switching supply elements and magnetic heads, various motor components, solenoids for automobiles, various magnetic sensors, various solenoid valves, and the like. The compound magnetic material includes a plurality of compound magnetic particles bound together by an organic resin. The compound magnetic particle includes a metal magnetic particle, and a coat layer containing metal oxide, bound to the surface of the metal magnetic particle. The organic resin has a long-period heat resistance temperature of at least 200° C. The ratio of the organic resin to the compound magnetic particles exceeds 0 mass % and not more than 0.2 mass %. Preferably, the ratio of the organic resin to the compound magnetic particles is at least 0.01 mass % and not more than 0.15 mass %.

BEST MODE FOR CARRYING OUT THE INVENTION

First Embodiment

Figure 1:
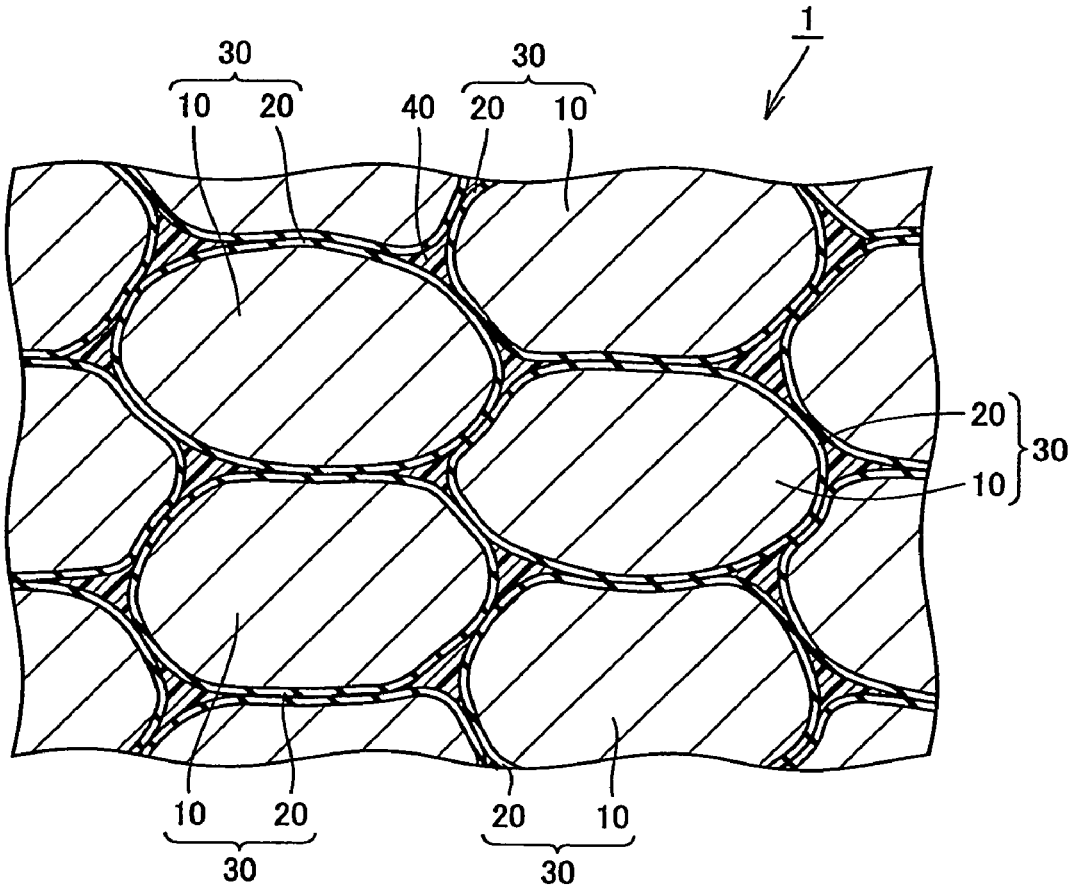
FIG. 1 is a sectional view of Sample 2.

As compound magnetic particles, Somaloy (trade name) available from Heganes Corporation was prepared. The particle has a coat layer formed of metal oxide including phosphorus and iron applied on the surface of iron powder as a metal magnetic particle. The average grain size of the compound magnetic particle is not more than 150 μm. The average thickness of the coat layer is 20 nm.

Polyether ether ketone resin particles were prepared having the mass ratio of 0.01%, 0.10%, 0.15%, 0.20%, 0.30%, 1.00%, and 3.00% to the compound magnetic particles.

These were combined in a ball mill to produce mixed powder. The combining method is not particularly limited. For example, mechanical alloying, oscillation ball mill, planetary ball mill, mechanofusion, coprecipitation method, chemical vapor deposition (CVD), physical vapor deposition (PVD), plating, sputtering, vapor deposition, sol-gel method and the like can be employed.

The mixed powder was introduced into a die. Compacting was conducted to obtain a compact. As the compacting method, die wall lubrication compacting of applying a lubricant to the die for compacting was employed. As the lubricant, stearic acid, metallic soap, amide based wax, thermoplastic resin, polyethylene, or the like can be employed. In the present embodiment, metallic soap was employed.

A compact was formed with the temperature of the die at 130° C., the temperature of mixed powder at 130° C. and the mold pressure of 784 MPa. The temperature of the die can be set in the range of 70° C. to 150° C., the temperature of mixed powder to the range of 70° C. to 150° C., and the compacting pressure to the range of 392 MPa to 980 MPa.

Also, a compact was obtained by compacting a sample including only compound magnetic particles, absent of polyether ether ketone particle, by die wall lubrication.

The compact was subjected to a heat treatment (annealing) at the temperature of 420° C. in nitrogen gas ambient. Accordingly, the polyether ether ketone was softened to permeate into the interface between the plurality of compound magnetic particles, whereby compound magnetic particles are bound with each other, resulting in a solid. The compact absent of polyether ether ketone was also subjected to a heat treatment to achieve a solid.

The temperature of the heat treatment is preferably at least 340° C. and not more than 450° C. If this temperature is lower than 340° C., polyether ether ketone will not be completely softened, and will not be diffused uniformly. If the temperature is higher than 450° C., polyether ether ketone is decomposed, whereby the strength of the compound magnetic material will not be improved. If the heat treatment is conducted in the atmosphere, polyether ether ketone is rendered a gel, whereby the strength of the compound magnetic material is degraded. If the heat treatment is carried out in argon or helium, the fabrication cost will increase. As the heat treatment, HIP (Hot Isostatic Pressing), or SPS (Spark Plasma Sintering), can be employed.

At the last stage, the solid is worked to obtain a compound magnetic material (Samples 1-8).

FIG. 1 is a sectional view of Sample 2. Referring to FIG. 1, compound magnetic material 1 (Sample 2) includes a plurality of compound magnetic particles 30 bound together through an organic resin 40. Compound magnetic particle 30 includes a metal magnetic particle 10, and a coat layer 20 containing metal oxide, bound at the surface of metal magnetic particle 10. Organic resin 40 has a long-period heat resistance temperature of at least 200° C.

The transverse rupture strength at the temperature of 200° C., the magnetic flux density when a magnetic field of 12000 A/m is applied, the electrical resistivity, and density were measured for Samples 1-8. The transverse rupture strength at 200° C. was evaluated by forming the composite magnetic material in a prism configuration of 10 mm×50 mm×10 mm (length×width, thickness) to which a three-point bending test was conducted at the temperature of 200° C. with a span of 40 mm. The results are shown in the following Table 1.

Second Embodiment

In the second embodiment, a lubricant (zinc stearate) was blended (0.3 mass %) into mixed powder in advance, and the added amount of PEEK was altered to various levels to obtain mixed powder. A solid was obtained by subjecting the mixed powder to compacting and heat treatment without applying a lubricant to the surface of the die. The solid was worked to obtain a compound magnetic material (Samples 9-13). The pressure in the compacting step, temperature, and heat treatment temperature are identical to those of the first embodiment.

Mixed powder having a composition similar to that of Sample 3 was molded at the same pressure as the first embodiment at the temperature of 150° C. or 70° C. Then, a heat treatment at the temperature similar to that of the first embodiment was applied to obtain a solid. The solid was worked to obtain a compound magnetic material (Samples 14 and 15).

TABLE 1

| Sample No. | Mold Temperature | Lubrication Method | Amount of Lubricant in Mixed Powder (Mass %) | Standard (target) PEEK Amount (Mass %) | At least 100 MPa Transverse rupture strength at 200° C. (MPa) | At least 15 kG Magnetic Flux Density (kG) | At least 10 × $10^{-4}$ Ωcm Electrical Resistivity (×$10^{-4}$ Ω cm) | At least 7.5 g/cm$^3$ Density (g/cm$^3$) | Note |
|---|---|---|---|---|---|---|---|---|---|
| 1 | Warm compacting (130° C.) | Die wall lubrication (1) | — | 0.00 | 136 | 16.5 | 3.2 | 7.58 | Comparative Examples |
| 2 | | | | 0.01 | 136 | 16.4 | 9.8 | 7.56 | Sample of Present Invention |
| 3 | | | | 0.10 | 136 | 16.3 | 12 | 7.55 | |
| 4 | | | | 0.15 | 128 | 16.3 | 16 | 7.54 | |
| 5 | | | | 0.20 | 113 | 15.6 | 21 | 7.50 | |
| 6 | | | | 0.30 | 106 | 15.2 | 27 | 7.46 | Comparative Examples |
| 7 | | | | 1.00 | 97 | 13.8 | 62 | 7.12 | |
| 8 | | | | 3.00 | 64 | 10.2 | 120 | 6.52 | |
| 9 | | Internal blending (2) | 0.3 | 0.00 | 84 | 16.0 | 22 | 7.55 | |
| 10 | | | | 0.10 | 62 | 15.8 | 25 | 7.51 | |
| 11 | | | | 0.30 | 56. | 14.6 | 84 | 7.40 | |
| 12 | | | | 1.00 | 42 | 13.0 | 103 | 7.02 | |
| 13 | | | | 3.00 | 44 | 9.5 | 224 | 6.41 | |
| 14 | Warm compacting (150° C.) | Die wall lubrication | — | 0.10 | 133 | 16.6 | 13.2 | 7.57 | Sample of Present Invention |
| 15 | Warm compacting (70° C.) | Die wall lubrication | — | 0.10 | 128 | 16.2 | 11.6 | 7.53 | |
| 16 | Room temperature (20° C.) | Die wall lubrication (3) | — | 0.00 | 68 | 14.9 | 0.12 | 7.43 | Comparative Examples |
| 17 | | | | 0.10 | 53 | 14.8 | 4.5 | 7.40 | |
| 18 | | | | 0.30 | 50 | 14.6 | 9.3 | 7.34 | |
| 19 | | | | 1.00 | 42 | 12.8 | 33 | 6.99 | |
| 20 | | | | 3.00 | 36 | 9.2 | 108 | 6.38 | |
| 21 | | Internal blending (4) | 0.45 | 0.10 | 39 | 14.6 | 620 | 7.33 | |
| 22 | | | | 0.30 | 40 | 13.8 | 760 | 7.25 | |
| 23 | | | | 0.45 | 45 | 13.5 | 730 | 7.18 | |
| 24 | | | | 0.60 | 41 | 13.4 | 720 | 7.12 | |

It is appreciated from Table 1 that Samples 2-5 according to the present invention are superior in all the properties. Sample 1 that is a Comparative Example had great friction between the compound magnetic particles during the compacting step since PEEK is not added. Therefore, the insulation coat at the surface of the compound magnetic particle was fractured. The desired electrical resistivity could not be achieved. Samples 6-8 which are Comparative Examples exhibited lower transverse rupture strength at 200° C. and magnetic flux density since the amount of PEEK was too high. Therefore, the ratio of PEEK is particularly preferably set to at least 0.01 mass % and not more than 0.15 mass %.

Furthermore, a composite magnetic material subjected to a compacting step at the temperature of 20° C. of the first embodiment, and then a heat treatment at a temperature identical to that of the first embodiment was obtained (Samples 16-20).

Also, a lubricant (zinc stearate) was blended (0.45 mass %) into mixed powder in advance, and the added amount of PEEK was altered variously to obtain mixed powder. The mixed powder was molded at the temperature of 20° C. without a lubricant applied to the surface of the die, and then subjected to heat treatment to obtain a solid. The solid was worked to obtain a compound magnetic material (Samples 21-24). The pressure during the compacting step, and the heat treatment temperature are similar to those of the first embodiment.

For Samples 9-20, the transverse rupture strength at the temperature of 200° C., the magnetic flux density when a magnetic field of 12000 A/m is applied, the electrical resistivity and density were measured. The transverse rupture strength at 200° C. was evaluated by forming the composite magnetic material in a prism configuration of 10 mm×50 mm×10 mm (length×width, thickness) to which a three-point bending test was conducted at the temperature of 200° C. with a span of 40 mm. The results are shown in the following Table 1.

It is appreciated from Table 1 that Samples 9-13 that are Comparative Examples exhibited reduction in the transverse rupture strength and magnetic flux density. Samples 14 and 15 corresponding to the present invention exhibited superior properties in all aspects. Samples 16-24 identified as Comparative Examples subjected to compacting at room temperature exhibited reduction in density. It is therefore difficult to achieve the target magnetic flux density.

It is to be noted that Samples 21-24 exhibited the highest transverse rupture strength when the PEEK amount was set lower than 0.45 mass %. This is because the strength as a whole is reduced if the PEEK amount is below 0.45 mass % since the bind strength of PEEK is the governing strength factor and if the PEEK amount exceeds 0.45 mass % since the bond strength between compound magnetic particle is reduced.

In view of the foregoing, die wall lubrication must be conducted and the PEEK amount must be set to exceed 0 mass % and not more than 0.2 mass % in order to achieve the desired properties. It is further preferable to set the PEEK amount to at least 0.01 mass % and not more than 0.15 mass %.

According to the present invention, the strength at high temperature is increased since the long-period heat resistance temperature of polyether ether ketone is at least 200° C. The heat resistance of the compound magnetic material is improved. Since polyether ether ketone has low viscosity when softened (melt viscosity), even a small amount will induce the capillarity, leading to uniform diffusion. Also, since reliable binding between compound magnetic particles can be achieved even with a small amount, the required amount of organic resin can be reduced. As a result, the ratio of the metal magnetic material can be increased to allow higher magnetic properties.

Usage of die wall lubrication compacting allows the amount of lubricant in the compact to be reduced. As a result, the density of the compound magnetic material is improved to allow higher magnetic properties. Furthermore, the magnetic permeability can be improved since generation of voids in the compact can be suppressed.

Each of the disclosed embodiments is only a way of example, and various modifications are allowed.

For example, although the coat layer is formed of an oxide including phosphorus and iron in the above embodiments, advantages similar to those of the above embodiments can be offered by forming the coat layer from metal oxide magnetic particles. In this case, the metal magnetic particles and metal oxide magnetic particles must be mixed. The method of mixing the metal magnetic particles with the metal oxide magnetic particles is not particularly limited. For example, mechanical alloying, ball mill, oscillation ball mill, planetary ball mill, mechanofusion, coprecipitation, chemical vapor deposition (CVD), physical vapor deposition (PVD), plating, sputtering, vapor deposition, sol-gel method, or the like can be employed.

Each of the embodiments disclosed here is only a way of example, and is not to be taken by way of limitation. The scope of the present invention is defined by the appended claims rather than by the description above. All changes that fall within limits and bounds of the claims, or equivalents of such metes and bounds are therefore intended to be embraced by the claims.

According to the present invention, a compound magnetic material having high heat resistance can be obtained.

INDUSTRIAL APPLICABILITY

The compound magnetic material according to the present invention can be employed as the component constituting the control mechanism of an automobile engine.

The invention claimed is:

1. A fabrication method of fabricating a compound magnetic material comprising the steps of:

preparing a mixed powder including an organic resin and compound magnetic particles, said organic resin being polyether ether ketone (PEEK) having a long-period heat resistance temperature of at least 200° C., said organic resin having a ratio exceeding 0 mass % and not more than 0.2 mass % to said compound magnetic particles, said compound magnetic particle including a metal magnetic particle, and a coat layer including a metal oxide, directly bound to a surface of said metal magnetic particle;

forming a compact by introducing said mixed powder into a die having a lubricant applied to its surface and conducting warm-compacting; and applying a heat treatment to said compact.

2. The fabrication method of a compound magnetic material according to claim 1, wherein said step of preparing said mixed powder includes the step of preparing said mixed powder having a ratio of said organic resin to said compound magnetic particles set to at least 0.01 mass % and not more than 0.15 mass %.

3. The fabrication method of a compound magnetic material according to claim 1, wherein said step of forming a compact includes the step of warm-compacting said mixed powder at a temperature of at least 70° C. and not more than 150° C.

4. The fabrication method of a compound magnetic material according to claim 1, wherein said step of preparing said mixed powder includes the step of preparing said mixed powder including said organic resin, and said compound magnetic particles, and having inevitable impurities as a remainder.

5. A compound magnetic material including a plurality of compound magnetic particles bound to each other through an organic resin, said compound magnetic particle including a metal magnetic particle, and a coat layer containing metal oxide, bound to the surface of said metal magnetic particle, said organic resin being polyether ether ketone (PEEK) having a long-period heat resistance temperature of at least 200° C., and said organic resin having a ratio exceeding 0 mass % and not more than 0.2 mass % to said compound magnetic particles.

6. The compound magnetic material according to claim 5, wherein the ratio of said organic resin to said compound magnetic particles is at least 0.01 mass % and not more than 0.15 mass %.

* * * * *

UNITED STATES PATENT AND TRADEMARK OFFICE

CERTIFICATE OF CORRECTION

PATENT NO. : 7,258,812 B2
APPLICATION NO. : 10/490096
DATED : August 21, 2007
INVENTOR(S) : Shimada et al.

It is certified that error appears in the above-identified patent and that said Letters Patent is hereby corrected as shown below:

Title page,
Item [57], ABSTRACT,
Line 9, after “metal magnetic”; replace “particles” by --particle--;

Column 4,
Line 1, after “moplastic”, replace “polyalnideimide” by --polyamideimide--;
Line 46, after “copper”, replace “(Cu)zinc” by --(Cu)-zinc--;

Column 5,
Line 34, after “resistivity”, replace “p” by --ρ--;
Line 35, after "cm", replace "." by --,--;

Column 6,
Line 5, after "BEST", replace "MODE" by --MODES--.

Signed and Sealed this

Sixth Day of May, 2008

JON W. DUDAS
*Director of the United States Patent and Trademark Office*